US010257629B2

(12) United States Patent
Liu et al.

(10) Patent No.: US 10,257,629 B2
(45) Date of Patent: Apr. 9, 2019

(54) EVENT DETECTION BY MICROPHONE

(71) Applicant: Vivint, Inc., Provo, UT (US)

(72) Inventors: Shiwei Liu, Lehi, UT (US); Aaron Davis, Pleasant Grove, UT (US); Justin Peel, Millcreek, UT (US); Rongbin Lanny Lin, Draper, UT (US); Brandon Bunker, Highland, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/490,646

(22) Filed: Apr. 18, 2017

(65) Prior Publication Data

US 2018/0302730 A1 Oct. 18, 2018

(51) Int. Cl.

| | |
|---|---|
| ***H04R 29/00*** | (2006.01) |
| ***G10L 25/51*** | (2013.01) |
| ***G10L 25/90*** | (2013.01) |

(52) U.S. Cl.

CPC ..... *H04R 29/00* (2013.01); *G10L 25/51* (2013.01); *G10L 25/90* (2013.01)

(58) Field of Classification Search

CPC ..... H04R 29/00; G10L 25/51; G10L 25/90
See application file for complete search history.

(56) References Cited

U.S. PATENT DOCUMENTS

| | | | |
|---|---|---|---|
| 6,957,157 | B2 | 10/2005 | Lander |
| 8,310,369 | B1 | 11/2012 | Canfield et al. |
| 8,918,294 | B2 | 12/2014 | Stevens et al. |
| 2003/0040915 | A1 | 2/2003 | Aubauer |
| 2004/0128034 | A1 | 7/2004 | Lenker et al. |
| 2006/0174707 | A1 | 8/2006 | Zhang |
| 2017/0097618 | A1 | 4/2017 | Cipollo et al. |

FOREIGN PATENT DOCUMENTS

| | | | | |
|---|---|---|---|---|
| KR | 1020050049977 | A | 5/2005 | |
| KR | 101434515 | B1 | 8/2014 | |
| KR | 102008096239 | A | 10/2018 | |
| WO | WO 2015191722 | A1 * | 12/2015 | ..... G08B 13/04 |

OTHER PUBLICATIONS

PCT International Search Report for International Application No. PCT/US2018/027804, dated Jul. 27, 2018 (3 pp.).

* cited by examiner

*Primary Examiner* — David Ton
(74) *Attorney, Agent, or Firm* — Holland & Hart LLP

(57) ABSTRACT

A method for security and/or automation systems is described. In one embodiment, the method includes detecting a sound using a microphone, generating an audio signature of the detected sound, comparing the audio signature of the detected sound to an audio signature of a characterized sound, and determining whether a recognizable event occurs based on the comparison. In some embodiments, the microphone is attached to a pipe at the premises.

16 Claims, 7 Drawing Sheets

EVENT DETECTION BY MICROPHONE

BACKGROUND

The present disclosure, for example, relates to security and/or automation systems, and more particularly to detecting events.

Security and automation systems are widely deployed to provide various types of communication and functional features such as monitoring, communication, notification, and/or others. These systems may be capable of supporting communication with a user through a communication connection or a system management action.

A first type of sensor may be implemented to detect a first type of event, while a second type of sensor may be implemented to detect a second type of event. Enabling a premises to detect several types of events may include implementing several sorts of sensors around the premises. Implementing several sorts of sensors around the premises to detect different types of events increase the complexity and cost of an automation system.

SUMMARY

The disclosure herein includes methods and systems for improving event detection. In some embodiments, the present systems and methods may improve an automation system by reducing a cost of implementation as well as reduce a complexity of installing and maintaining the system.

A method for security and/or automation systems is described. In one embodiment, the method may include detecting a sound using a microphone, generating an audio signature of the detected sound, comparing the audio signature of the detected sound to an audio signature of a characterized sound, and determining whether a recognizable event occurs based on the comparison.

In some embodiments, the microphone may be attached to a pipe at the premises. In some embodiments, when the audio signature of the detected sound matches the audio signature of the characterized sound, the method may include performing an automation task. In some cases, the automation task may include at least one of adjustment of a light setting in the premises, adjustment of a thermostat setting of the premises, adjustment of an appliance setting in the premises, adjustment of a machine in the premises, adjustment of a machine setting in the premises, adjustment of an automated locking mechanism, adjustment of a setting of the automation system, or any combination thereof.

In some embodiments, when the audio signature of the detected sound matches the audio signature of the characterized sound, the method may include logging information related to the detected sound to a database where the audio signature of the characterized sound is stored.

In some embodiments, the method may include, monitoring for recurrences of the characterized sound to identify typical times when the characterized sound occurs, typical rate of occurrence for the characterized sound, typical time span associated with the characterized sound, or any combination thereof.

In some embodiments, when the audio signature of the detected sound does not match the audio signature of the characterized sound, the method may include characterizing the non-matching detected sound. In some cases, the method may include generating a notification regarding the non-matching detected sound. In some examples, the notification may include at least a request for information regarding the non-matching detected sound. In some cases, the notification may include a prompt of whether to monitor for subsequent incidents of the non-matching detected sound.

In some embodiments, when a response to the prompt indicates to monitor for subsequent incidents of the non-matching detected sound, the method may include adding an audio signature of the non-matching detected sound to a database. In some cases, the method may include logging information related to the non-matching detected sound to the database upon detecting a subsequent incident of the non-matching detected sound. In some embodiments, when a response to the prompt indicates not to monitor for subsequent incidents of the non-matching detected sound, the method may include discarding an audio signature of the non-matching detected sound.

In some cases, the one or more attributes of the characterized sound may include at least one of pitch, frequency, wavelength, timbre, tone, and amplitude, or any combination thereof. In some cases, the characterized sound may include a first occupant exiting a first door, a second occupant exiting the first door, the first or second occupant exiting a second door, a garage door opening or closing, a first car starting, a second car starting, the first car leaving the premises, the second car leaving the premises, the first car arriving at the premises, the second car arriving at the premises, voice of the first occupant, voice of the second occupant, the first occupant getting into or out of a first bed, the second occupant getting into or out of a second bed, the first or second occupant walking from a first room to a second room, a furnace operating, an air conditioner operating, a swamp cooler operating, a television operating, a clothes washer operating, a clothes dryer operating, a dishwasher operating, a refrigerator operating, confirming an occurrence of an expected event within a certain time period, or any combination thereof.

An apparatus for security and/or automation systems is also described. In one embodiment, the apparatus may include a processor, memory in electronic communication with the processor, and instructions stored in the memory, the instructions being executable by the processor to perform the steps of detecting a sound using a microphone, generating an audio signature of the detected sound, comparing the audio signature of the detected sound to an audio signature of a characterized sound, and determining whether a recognizable event occurs based on the comparison.

A non-transitory computer-readable medium is also described. The non-transitory computer readable medium may store computer-executable code, the code being executable by a processor to perform the steps of detecting a sound using a microphone, generating an audio signature of the detected sound, comparing the audio signature of the detected sound to an audio signature of a characterized sound, and determining whether a recognizable event occurs based on the comparison.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Figure 1:
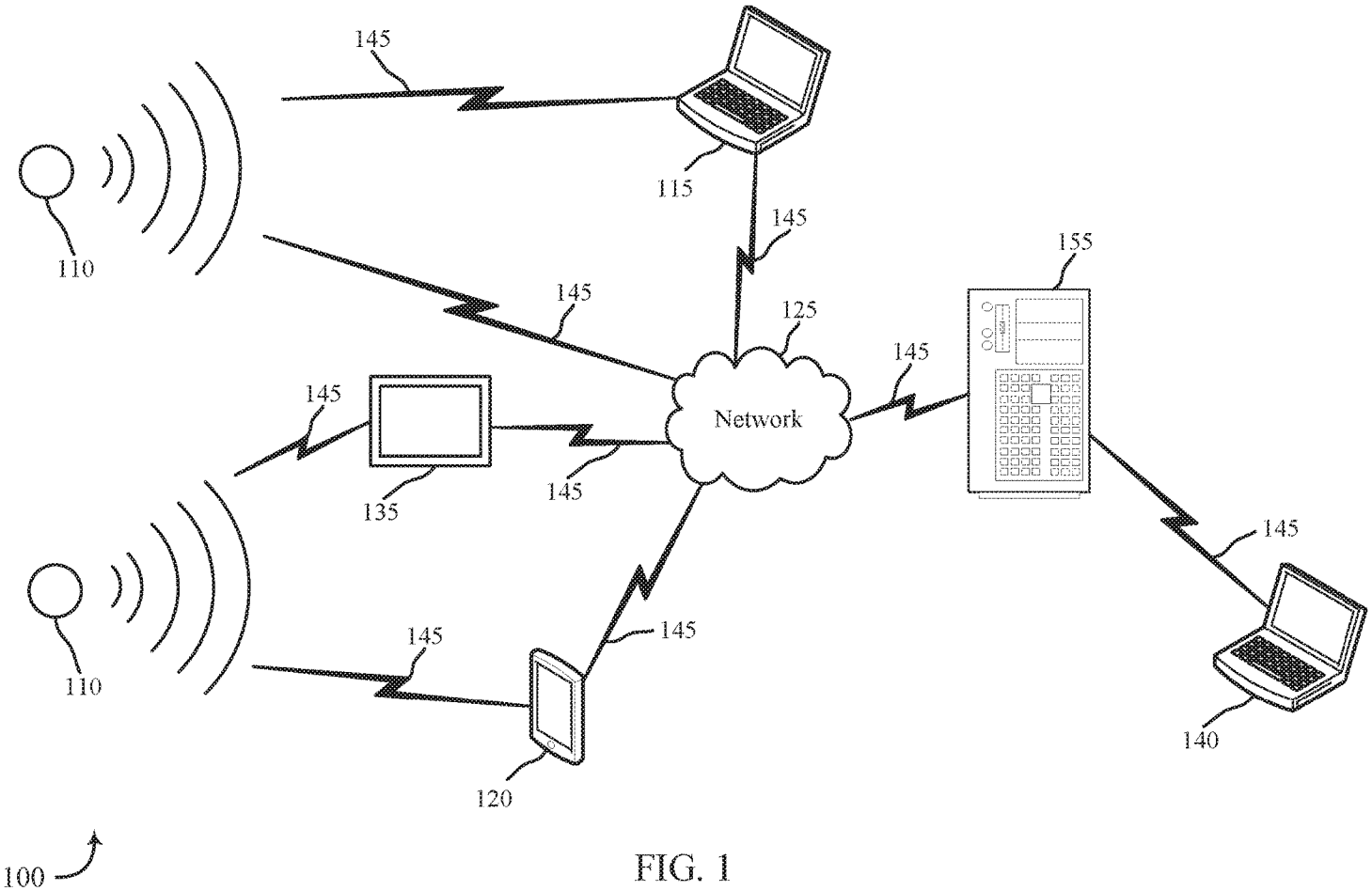
FIG. 1 is a block diagram of an example of a security and/or automation system in accordance with various embodiments.

The following relates generally to automation and/or security systems. More specifically, the systems and methods described herein relate to detecting events in a building in relation to an automation system. Some embodiments of the systems and methods described herein relate to detecting events of a building in relation to a microphone sensor attached to a pipe at a premises.

Conventional automation systems may include multiple sensors located at an entrance to a premises, a back door of the premise, multiple windows of the premise, multiple rooms of the premise, and so on, resulting in an expensive and complicated configuration. However, based on the present systems and methods, several sensors may be replaced by a single microphone sensor attached to a pipe at a premises. The microphone may monitor noises and vibrations in relation to a system of pipes in the premises. Multiple sounds or vibrations may be characterized by the automation system and stored in a database. Thus, subsequent detections of sounds and vibrations may be recognized by the automation system based at least in part on the stored characterizations of multiple sounds and vibrations.

In one embodiment, via the microphone sensor, the automation system may monitor for sounds generated by occupants, animals, and/or devices in a premises. For example, a microphone sensor attached to a pipe may be mounted near a window located relative to a family room of a home. Such a home may include a number of human occupants and a pet. A microphone sensor attached to a pipe may detect sounds generated by both the occupants as well as a pet. Thus, according to the systems and methods described herein, a microphone sensor attached to a pipe may be configured to identify human-generated sounds and animal-generated sounds. In some cases, the sounds generated by passing occupants and/or pets may be analyzed in relation to human and pet sound profiles. The microphone sensor attached to the pipe may be configured to distinguish between human speech and animal sounds (e.g. dog bark, cat meow, etc.), as well as distinguish between human footsteps and animal footsteps (e.g. distinguish between biped footstep patterns and quadruped footstep patterns, etc.). In some cases, an automation system may determine a location of an event in the premises based on analysis of information received from two or more microphones attached to pipes in the premises.

In some embodiments, the microphone sensor attached to the pipe may be configured to distinguish between the sounds of a first device and the sounds of a second device. For example, the microphone sensor attached to the pipe may be configured to detect and distinguish the sounds of a television while operating from the sounds of a microwave while operating. In some cases, an automation system may implement one or more automation actions based at least in part on certain events being detected. For example, upon determining the microphone sensor detects an occupant entering a room, the automation system may turn on a light in that room. Accordingly, a single sensor attached to a pipe in a premises may detect multiple events and may trigger one or more automation actions based on which events are detected.

FIG. 1 is an example of a communications system 100 in accordance with various aspects of the disclosure. In some embodiments, the communications system 100 may include one or more sensor units 110, local computing device 115, 120, network 125, server 155, control panel 135, and remote computing device 140. One or more sensor units 110 may communicate via wired or wireless communication links 145 with one or more of the local computing device 115, 120 or network 125. The network 125 may communicate via wired or wireless communication links 145 with the control panel 135 and the remote computing device 140 via server 155. In alternate embodiments, the network 125 may be integrated with any one of the local computing device 115, 120, server 155, and/or remote computing device 140, such that separate components are not required.

Local computing device 115, 120 and remote computing device 140 may be custom computing entities configured to interact with sensor units 110 via network 125, and in some embodiments, via server 155. In other embodiments, local computing device 115, 120 and remote computing device 140 may be general purpose computing entities such as a personal computing device, for example, a desktop computer, a laptop computer, a netbook, a tablet personal computer (PC), a control panel, an indicator panel, a multi-site dashboard, an IPOD®, an IPAD®, a smart phone, a mobile phone, a personal digital assistant (PDA), and/or any other suitable device operable to send and receive signals, store and retrieve data, and/or execute modules.

Control panel 135 may be a smart home system panel, for example, an interactive panel mounted on a wall in a user's home. Control panel 135 may be in direct communication via wired or wireless communication links 145 with the one or more sensor units 110, or may receive sensor data from the one or more sensor units 110 via local computing devices 115, 120 and network 125, or may receive data via remote computing device 140, server 155, and network 125.

The local computing devices 115, 120 may include memory, at least one processors, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115, 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110.

The processor of the local computing devices 115, 120 may be operable to control operation of the output of the local computing devices 115, 120. The output may be a television, a liquid crystal display (LCD) monitor, a cathode ray tube (CRT) monitor, speaker, tactile output device, and/or the like. In some embodiments, the output may be an integral component of the local computing devices 115, 120. Similarly stated, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115, 120 to the output.

The remote computing device 140 may be a computing entity operable to enable a remote user to monitor the output of the sensor units 110. The remote computing device 140 may be functionally and/or structurally similar to the local computing devices 115, 120 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via wireless communication links 145 and server 155.

In some embodiments, the one or more sensor units 110 may be sensors configured to conduct periodic or ongoing automatic measurements related to audio and/or image data signals. Each sensor unit 110 may be capable of sensing multiple audio and/or image parameters, or alternatively, separate sensor units 110 may monitor separate audio and image parameters. In some cases, at least one sensor unit 110 may include a processor, memory, and/or storage. In some examples, at least one sensor unit 110 may process data and send the processed data to another device such as a control panel of an automation system. For example, one sensor unit 110 may monitor audio (e.g., sound of an occupant, sound of a pet, sound of a machine in operation, etc.), while another sensor unit 110 (or, in some embodiments, the same sensor unit 110) may detect images (e.g., photo, video, motion detection, infrared, etc.).

Data gathered by the one or more sensor units 110 may be communicated to local computing device 115, 120, which may be, in some embodiments, a thermostat or other wall-mounted input/output smart home display. In other embodiments, local computing device 115, 120 may be a personal computer and/or smart phone. Where local computing device 115, 120 is a smart phone, the smart phone may have a dedicated application directed to collecting audio and/or video data and calculating object detection therefrom. The local computing device 115, 120 may process the data received from the one or more sensor units 110 to obtain a probability of an object within an area of a premises such as an object within a predetermined distance of an entrance to the premises as one example. In alternate embodiments, remote computing device 140 may process the data received from the one or more sensor units 110, via network 125 and server 155, to obtain a probability of detecting an object within the vicinity of an area of a premises, such as detecting a person at an entrance to the premises for example. Data transmission may occur via, for example, frequencies appropriate for a personal area network (such as BLUETOOTH® or IR communications) or local or wide area network frequencies such as radio frequencies specified by the IEEE 802.15.4 standard, among others.

In some embodiments, local computing device 115, 120 may communicate with remote computing device 140 or control panel 135 via network 125 and server 155. Examples of networks 125 include cloud networks, local area networks (LAN), wide area networks WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 115, 120 from remote computing device 140. For example, in some embodiments, remote computing device 140 may include a mobile application that interfaces with one or more functions of local computing device 115, 120.

The server 155 may be configured to communicate with the sensor units 110, the local computing devices 115, 120, the remote computing device 140 and control panel 135. The server 155 may perform additional processing on signals received from the sensor units 110 or local computing devices 115, 120, or may simply forward the received information to the remote computing device 140 and control panel 135.

Server 155 may be a computing device operable to receive data streams (e.g., from sensor units 110 and/or local computing device 115, 120 or remote computing device 140), store and/or process data, and/or transmit data and/or data summaries (e.g., to remote computing device 140). For example, server 155 may receive a stream of passive audio data from a sensor unit 110, a stream of active audio data from the same or a different sensor unit 110, a stream of image (e.g., photo and/or video) data from either the same or yet another sensor unit 110, and a stream of motion data from either the same or yet another sensor unit 110.

In some embodiments, server 155 may "pull" the data streams, e.g., by querying the sensor units 110, the local computing devices 115, 120, and/or the control panel 135. In some embodiments, the data streams may be "pushed" from the sensor units 110 and/or the local computing devices 115, 120 to the server 155. For example, the sensor units 110 and/or the local computing device 115, 120 may be configured to transmit data as it is generated by or entered into that device. In some instances, the sensor units 110 and/or the local computing devices 115, 120 may periodically transmit data (e.g., as a block of data or as one or more data points).

The server 155 may include a database (e.g., in memory and/or through a wired and/or a wireless connection) containing audio and/or video data received from the sensor units 110 and/or the local computing devices 115, 120. Additionally, as described in further detail herein, software (e.g., stored in memory) may be executed on a processor of the server 155. Such software (executed on the processor) may be operable to cause the server 155 to monitor, process, summarize, present, and/or send a signal associated with resource usage data.

Figure 2:
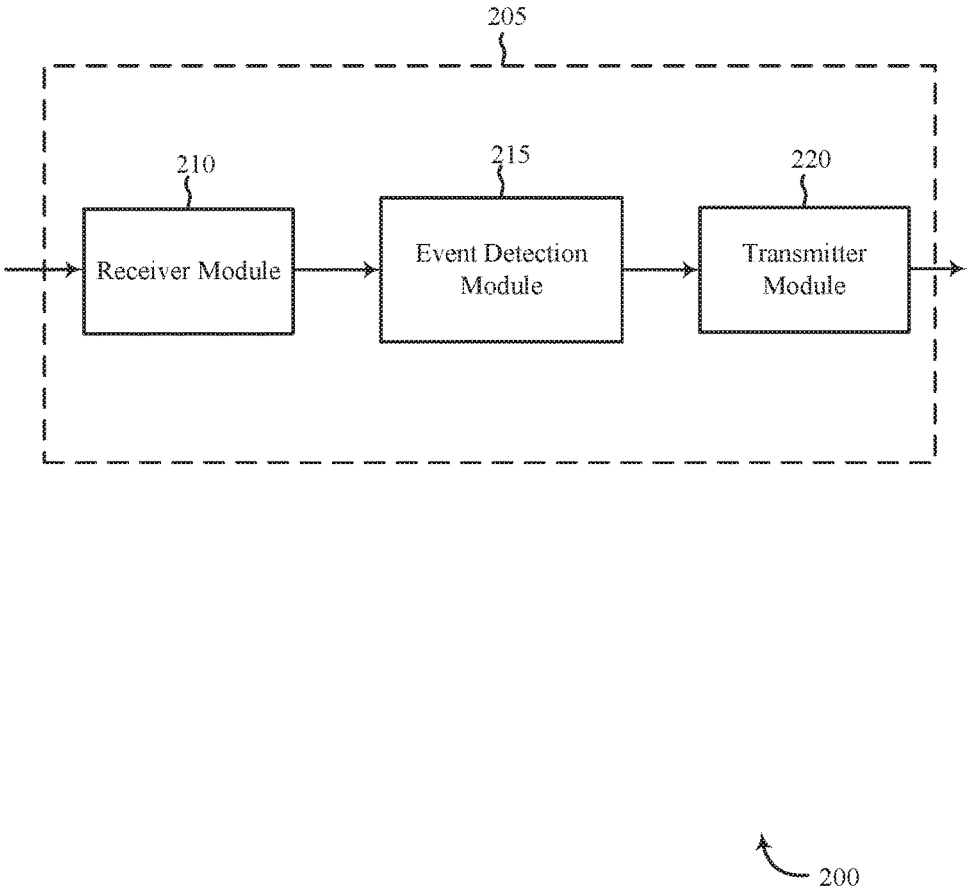
FIG. 2 shows a block diagram of a device relating to a security and/or an automation system, in accordance with various aspects of this disclosure.

FIG. 2 shows a block diagram 200 of an apparatus 205 for use in electronic communication, in accordance with various aspects of this disclosure. The apparatus 205 may be an example of one or more aspects of a control panel 135 described with reference to FIG. 1. The apparatus 205 may include a receiver module 210, an event detection module 215, and/or a transmitter module 220. The apparatus 205 may also be or include a processor. Each of these modules may be in communication with each other and/or other modules—directly and/or indirectly.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive audio signals and/or data (e.g., audio detected by a sensor, audio data generated by a sensor, data processed by a sensor, etc.) and/or image signals and/or data (e.g., images detected by a sensor, image data generated by a sensor, etc.). Information may be passed on to the event detection module 215, and to other components of the apparatus 205.

In one embodiment, events detection module 215 may include and/or operate in conjunction with at least one of software code, executable instructions, firmware, one or more processors, one or more memory devices, one or more storage devices, or any combination thereof, to perform at least one operation described herein. The event detection module 215 may be configured to sense events in a premises, analyze the detected events, and implement one or more automation actions based on the analysis. In some cases, event detection module 215 may generate a notification regarding a detected and/or analyzed event.

The transmitter module 220 may transmit the one or more signals received from other components of the apparatus 205. The transmitter module 220 may transmit audio signals and/or data (e.g., processed audio signals, processed audio data, etc.) and/or image signals and/or data (e.g., processed image signals, processed audio data, etc.). In some cases, transmitter module 220 may transmit results of data analysis on audio signals and/or audio data analyzed by event detection module 215. In some examples, the transmitter module 220 may be collocated with the receiver module 210 in a transceiver module. In other examples, these elements may not be collocated.

Figure 3:
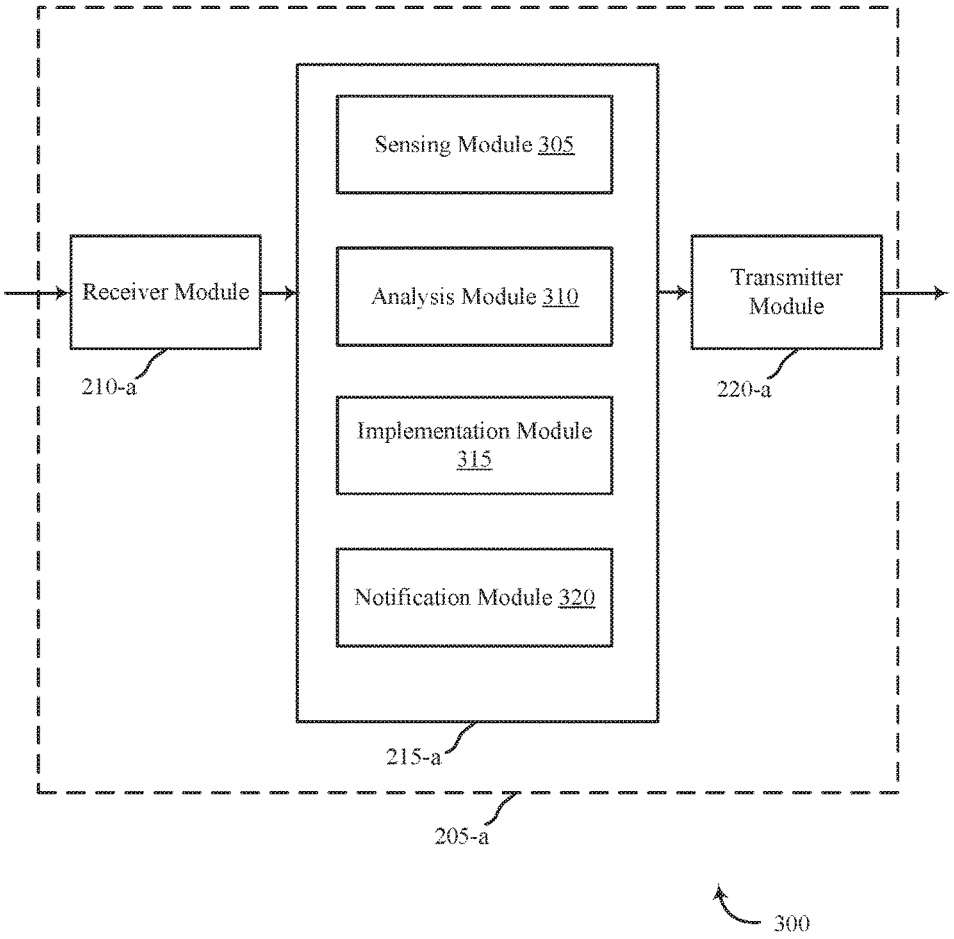
FIG. 3 shows a block diagram of a device relating to a security and/or an automation system, in accordance with various aspects of this disclosure.

FIG. 3 shows a block diagram 300 of an apparatus 205-*a* for use in wireless communication, in accordance with various examples. The apparatus 205-*a* may be an example of one or more aspects of a control panel 135 described with reference to FIG. 1. It may also be an example of an apparatus 205 described with reference to FIG. 2. The apparatus 205-*a* may include a receiver module 210-*a*, an event detection module 215-*a*, and/or a transmitter module 220-*a*, which may be examples of the corresponding modules of apparatus 205. The apparatus 205-*a* may also include a processor. Each of these components may be in communication with each other. The event detection module 215-*a* may include sensing module 305, analysis module 310, implementation module 315, and notification module 320. The receiver module 210-*a* and the transmitter module 220-*a* may perform the functions of the receiver module 210 and the transmitter module 220, of FIG. 2, respectively.

In one embodiment, sensing module 305 may be configured to sense or detect events in relation to a premises. In one embodiment, analysis module 310 may be configured to characterize a sound at a premises. In some embodiments, the characterized sound may include a first occupant exiting a first door, a second occupant exiting the first door, the first or second occupant exiting a second door, or any combination thereof. Additionally or alternatively, the characterized sound may include a garage door opening or closing, a first car starting, a second car starting, the first car leaving the premises, the second car leaving the premises, the first car arriving at the premises, the second car arriving at the premises, or any combination thereof. Additionally or alternatively, the characterized sound may include a voice of a first occupant, a voice of a second occupant, the first occupant getting into or out of a first bed, the second occupant getting into or out of a second bed, the first or second occupant walking from a first room to a second room, or any combination thereof. Additionally or alternatively, the characterized sound may include a furnace operating, an air conditioner operating, a swamp cooler operating, a television operating, a clothes washer operating, a clothes dryer operating, a dishwasher operating, a refrigerator operating, confirming an occurrence of an expected event within a certain time period, or any combination thereof.

In some embodiments, analysis module 310 may be configured to generate an audio signature of the characterized sound. In some cases, the audio signature may include one or more attributes of the characterized sound. In some cases, the one or more attributes of the characterized sound or any sound being characterized may include at least one of length or time period, pitch, frequency, wavelength, timbre, tone, and amplitude, or any combination thereof.

In one embodiment, implementation module 315 may be configured to add the audio signature of the characterized sound to a database of audio signatures. For example, an automation system may include a database to store characterized sounds. In some cases, the database may be local to the premises. Additionally or alternatively, the database may be at a remote storage location such as in cloud storage, etc.

In one embodiment, sensing module 305 may be configured to detect a sound using a microphone. In some cases, the microphone may be attached to a pipe at a premises. In some cases, the operations of event detection module 215 described herein may be accomplished using a single microphone attached to a pipe at a premises. As one example, the microphone may be attached to a water pipe or plumbing pipe at the premises. Additionally or alternatively, the microphone may be attached to an electrical conduit. The pipe may be made of at least one of metal, plastic, fiber, and fired clay, or any combination thereof. In some cases, the pipe may be made of metal such as copper, lead, steel, or any combination thereof. Additionally or alternatively, the pipe may be made of plastic such as polyvinyl chloride (PVC), chlorinated PVC, acrylonitrile butadiene styrene (ABS), cross-linked polyethylene (PEX), or any combination thereof.

In some embodiments, sensing module 305 may be configured to monitor for recurrences of the characterized sound to identify typical times when the characterized sound occurs, typical rate of occurrence for the characterized sound, typical time span associated with the characterized sound, or any combination thereof. For example, sending module 305 may determine that an occupant typically returns home between the hours of 5:00 PM and 5:00 PM Monday through Friday, that a television is typically operating between the hours of 7:00 PM and 9:00 PM on Mondays, that that the television is typically operating between the hours of 8:00 PM and 11:00 PM on Fridays, etc.

In some embodiments, implementation module 315 may be configured to generate an audio signature for a sound detected by sending module 305. In some embodiments, analysis module 310 may be configured to compare the audio signature of the detected sound to the audio signature of the characterized sound. For example, analysis module 310 may compare the length of the detected sound to the length of the characterized sound. Additionally or alternatively, analysis module 310 may compare at least one of pitch, frequency, wavelength, timbre, tone, and amplitude, or any combination thereof, between the detected sound and characterized sound.

In some embodiments, analysis module 310 may be configured to determine whether a recognizable event occurs based on the comparison. In some embodiments, when the audio signature of the detected sound matches the audio signature of the characterized sound, implementation module 315 may be configured to perform an automation task. In some cases, the automation task may include at least one of an adjustment of a light setting in the premises, an adjustment of a thermostat setting of the premises, an adjustment of an appliance setting in the premises, an adjustment of a machine in the premises, an adjustment of a machine setting in the premises, an adjustment of an automated locking mechanism, an adjustment of a setting of the automation system, or any combination thereof.

In some cases, when the audio signature of the detected sound matches the audio signature of the characterized sound, implementation module 315 may be configured to log information related to the detected sound to the database associated with the audio signature of the characterized sound. In some cases, when the audio signature of the detected sound does not match the audio signature of the characterized sound, analysis module 310 may be configured to characterize the non-matching detected sound.

In some embodiments, when the audio signature of the detected sound does not match the audio signature of the characterized sound, notification module 320 may be configured to generate a notification regarding the non-matching detected sound. In some cases, the notification may include at least a request for information regarding the non-matching detected sound. In some embodiments, the notification may include a prompt of whether to monitor for subsequent incidents of the non-matching detected sound.

In some cases, when a response to the prompt indicates to monitor for subsequent incidents of the non-matching detected sound implementation module 315 may be configured to add an audio signature of the non-matching detected sound to the database. In some embodiments, when a response to the prompt indicates to monitor for subsequent incidents of the non-matching detected sound, implementation module 315 may be configured to log information related to the non-matching detected sound to the database upon detecting a subsequent incident of the non-matching detected sound. In some examples, when a response to the prompt indicates not to monitor for subsequent incidents of the non-matching detected sound, implementation module 315 may be configured to discard an audio signature of the non-matching detected sound.

Figure 4:
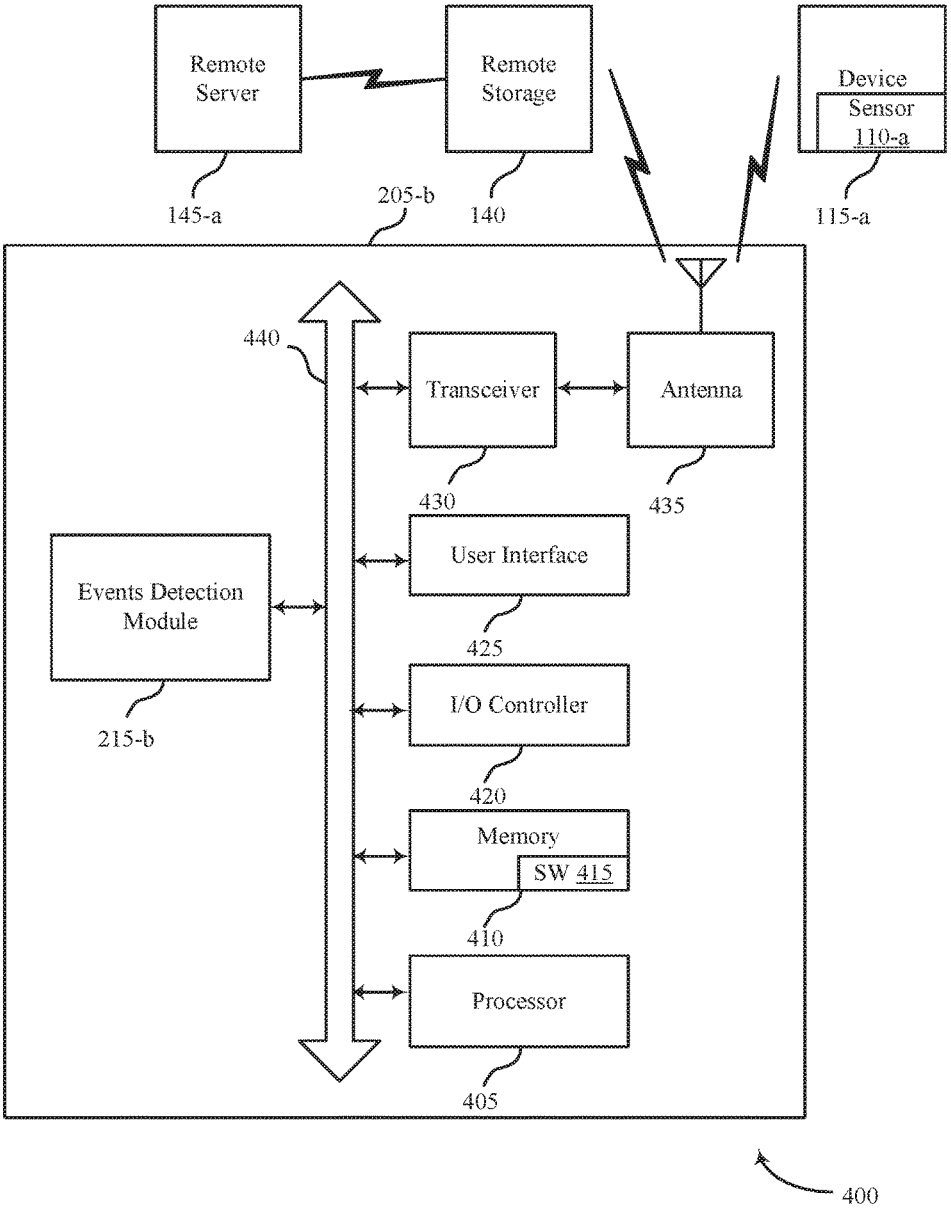
FIG. 4 shows a block diagram relating to a security and/or an automation system, in accordance with various aspects of this disclosure.

FIG. 4 shows a system 400 for use in automation systems, in accordance with various examples. System 400 may include an apparatus 205-*b*, which may be an example of the control panels 105 of FIG. 1. Apparatus 205-*b* may also be an example of one or more aspects of apparatus 205 and/or 205-*a* of FIGS. 2 and 3.

Apparatus 205-*b* may include components for bi-directional voice and data communications including components for transmitting communications and components for receiving communications. For example, apparatus 205-*b* may communicate bi-directionally with one or more of device 115-*a*, one or more sensors 110-*a*, remote storage 140, and/or remote server 145-*a*, which may be an example of the remote server of FIG. 1. This bi-directional communication may be direct (e.g., apparatus 205-*b* communicating directly with remote storage 140) and/or indirect (e.g., apparatus 205-*b* communicating indirectly with remote server 145-*a* through remote storage 140).

Apparatus 205-*b* may also include a processor module 405, and memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of device 115-*a*, remote storage 140, and/or remote server 145-*a*. The transceiver module 430 may include a modem to modulate the packets and provide the modulated packets to the one or more antennas 435 for transmission, and to demodulate packets received from the one 35, the control panel or the control device may also have multiple antennas 435 capable of concurrently transmitting or receiving multiple wired and/or wireless transmissions. In some embodiments, one element of apparatus 205-*b* (e.g., one or more antennas 435, transceiver module 430, etc.) may provide a direct connection to a remote server 145-*a* via a direct network link to the Internet via a POP (point of presence). In some embodiments, one element of apparatus 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensors 110-*a* (e.g., microphone, motion, proximity, security camera, image, smoke, light, glass break, door, audio, image, window, carbon monoxide, and/or another sensor) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of apparatus 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., detect an event and/or to determine whether to generate a notification, etc.). Alternatively, the software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, the event detection module 215 to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to and/or included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the control panel or control device (e.g., 205-*b*) may include a single antenna 435, the control panel or control device (e.g., 205-*b*) may have multiple antennas 435 capable of concurrently transmitting and/or receiving multiple wireless transmissions. The apparatus 205-*b* may include an event detection module 215-*b*, which may perform the functions described above for the event detection module 215 of apparatus 205 of FIGS. 2 and 3.

Figure 5:
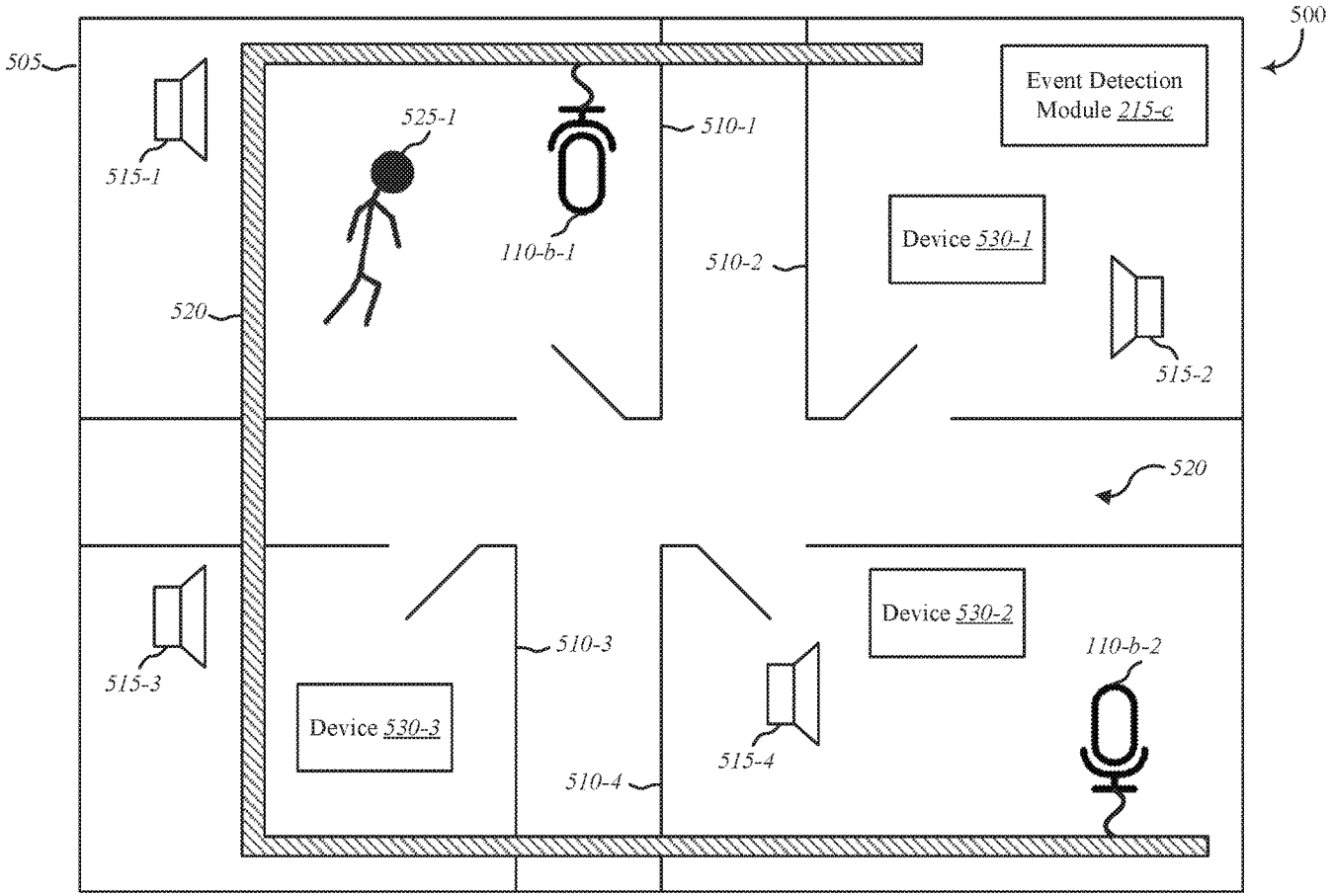
FIG. 5 is a block diagram illustrating one example of an environment for implementing one or more embodiments in accordance with various aspects of this disclosure.

FIG. 5 is a block diagram illustrating one example of an environment 500 for detecting events using event detection module 215-*c*. In some cases, event detection module 215-*c* may perform the functions described herein in conjunction with an automation system. In one embodiment, environment 500 may include premises 505. Examples of premises 505 may include a home, a place of business, a school, or any other sort of building. As depicted, premises 505 may include one or more rooms. For example, premises 505 may include rooms 510-1, 510-2, 510-5, and 510-4, as well as a central area 520 (e.g., a hallway, an entry way, an reception area, etc.). As depicted, event detection module 215-*c* may be located in one of the rooms. Alternatively, event detection module 215-*c* may be located at a location remote to premises 505. In some cases, a first portion of event detection module 215-*c* may be located at premises 505 and a second portion may be located at a remote location.

In some embodiments, premises 505 may include pipe 520. Examples of pipe 520 may include a plumbing pipe, an electrical conduit pipe, any other sort of pipe, or combination thereof. At least a portion of pipe 520 may be made of at least one of metal, plastic, fiber, and fired clay, or any combination thereof.

As illustrated, one or more rooms of premises 505 may include a speaker through which announcements may be made, as well as music, alerts, messages, alarms, and the like may be played. For example, room 510-1 may include speaker 515-1, room 510-2 may include speaker 515-2, room 510-3 may include speaker 515-3, and room 510-4 may include speaker 515-4. In some cases, certain rooms may be occupied. For example, at one point occupant 525-1 may occupy room 510-1. Additionally, or alternatively, occupant 525-1 may occupy any other room, move from one room to another, leave premises 505, or enter premises 505. In some cases, occupant 525-1 may occupy a room together with a second occupant. Additionally, or alternatively, occupant 525-1 may occupy a room of premises 505 while another occupant occupies a different room of premises 505.

In some embodiments, premises 505 may include one or more devices. In one embodiment, room 510-2 may include device 530-1, room 510-4 may include device 530-2, and room 510-3 may include device 530-3. Examples of devices 530 include a furnace, an air conditioner, a swamp cooler, a television, a radio, a clothes washer, a clothes dryer, a dishwasher, a refrigerator, an oven, a microwave oven, a clock, an alarm clock, a desktop computer, a laptop computer, a mobile computing device, or any combination thereof.

In some embodiments, each room may include one or more sensors communicatively coupled to event detection module 215-*c*. For example, room 510-1 may include sensor 110-*b*-1 and room 510-4 may include sensor 110-*b*-2. In some embodiments, sensor 110-*b*-1 may connect to pipe 520. For example, sensor 110-*b*-1 may include a first microphone attached to pipe 520. Similarly, sensor 110-*b*-2 may include a second microphone attached to pipe 520. In one embodiment, premises 505 may include a single microphone sensor attached to pipe 520. In some cases, other rooms of premises 505 may include sensors similar or different from sensors 110-*b*-1 and 110-*b*-2. In some embodiments, sensors 110-*b*-1 and/or 110-*b*-2 may be integrated with the speakers in the respective rooms. For example, sensor 110-*b*-1 may be integrated in speaker 515-1, etc.

As depicted, sensor 110-*b*-1 may detect occupant 525-1 in room 510-1. Similarly, sensor 110-*b*-2 may detect occupant 525-1 in room 510-1. In one embodiment, sensor 110-*b*-1 and/or 110-*b*-2 may detect a sound made by 525-1 such as a footstep, a voice sound, etc. In some cases, event detection module 215-*c* may locate occupant 525-1 based at least in part on the sound detected by sensor 110-*b*-1 analyzed in relation to the sound detected by sensor 110-*b*-2.

In some embodiments, both sensor 110-*b*-1 and sensor 110-*b*-2 may detect an operation of device 530-3 in room 510-3. Event detection module 215-*c* may analyze the sounds detected by sensors 110-*b*-1 and 110-*b*-2 to determine device 530-3 is operating and to identify the operation of device 530-3. As one example, event detection module 215-*c* may analyze the sounds detected by sensors 110-*b*-1 and 110-*b*-2 to determine that a clothes washer is operating and that the clothes washer is performing a rinse cycle.

In one embodiment, occupant 525-1 may generate an appointment by audibly stating details regarding an appointment in room 510-1. Sensor 110-*b*-1 may detect the audible statement made by occupant 525-1 and relay the associated data to the event detection module 215-*c*. In some cases, event detection module 215-*c* may generate and store the appointment by processing the received details of the appointment. In some embodiments, event detection module 215-*c* may recognize the identity of occupant 525-1 based on sensor 110-*b*-1 and/or sensor 110-*b*-2 sensing a sound made by occupant 525-1. For example, event detection module 215-*c* may recognize a footstep pattern made by occupant 525-1 in relation to other recognizable and unrecognizable footstep patterns. Similarly, event detection module 215-*c* may recognize a voice pattern made by occupant 525-1 in relation to other recognizable and unrecognizable voice patterns. Accordingly, event detection module 215-*c* may associate the generated appointment with the identity of occupant 525-1.

In some embodiments, event detection module 215-*c* may detect an unrecognizable occupant based at least in part on a voice pattern and/or footstep pattern detected by sensor 110-*b*-1 and/or sensor 110-*b*-2. In some cases, event detection module 215-*c* may generate a notification and send the notification to a predesignated recipient upon detecting an unrecognizable occupant. Additionally or alternatively, event detection module 215-*c* may generate an alarm upon detecting an unrecognizable occupant in premises 505.

In some embodiments, event detection module 215-*c*, may determine that only rooms 510-1 and 510-4 are occupied based at least in part on events detected by sensor 110-*b*-1 and/or sensor 110-*b*-2. Accordingly, event detection module 215-*c* may adjust one or more of devices 530 based on the occupancy determination. For example, event detection module 215-*c* may adjust a thermostat setting, a light setting, an appliance setting, a machine setting, or any combination thereof, in at least one of the rooms based on the occupancy determination.

In some embodiments, event detection module 215-*c* may detect an audio signal sounded at the environment 500. In some embodiments, sensor 110-*b*-1 and/or 110-*b*-2 may detect audio being played from at least one of speaker 515-1, 515-2, 515-3, and 515-4, or any combination thereof. As one example, sensor 110-*b*-1 may detect audio being played from speaker 515-1. Similarly, sensor 110-*b*-2 may detect the same audio being played from speaker 515-1. In some cases, event detection module 215-*c* may identify speaker 515-1 making the sound based at least in part on the sound detected by sensor 110-*b*-1 analyzed in relation to the sound detected by sensor 110-*b*-2.

In some cases, event detection module 215-*c* may detect an audio announcement being announced by one or more speakers in environment 500. In some embodiments, event detection module 215-*c* may record the announcement and send the recorded announcement to a predesignated recipient. In some cases, event detection module 215-*c* may detect an alarm or alert being sounded at environment 500 and send a notification regarding the alarm/alert. In some cases, event detection module 215-*c* may send a recording of the alarm/alert to a predesignated recipient. For example, a weather alert played over at least one speaker in environment 500 may be recorded and sent to the predesignated recipient.

Figure 6:
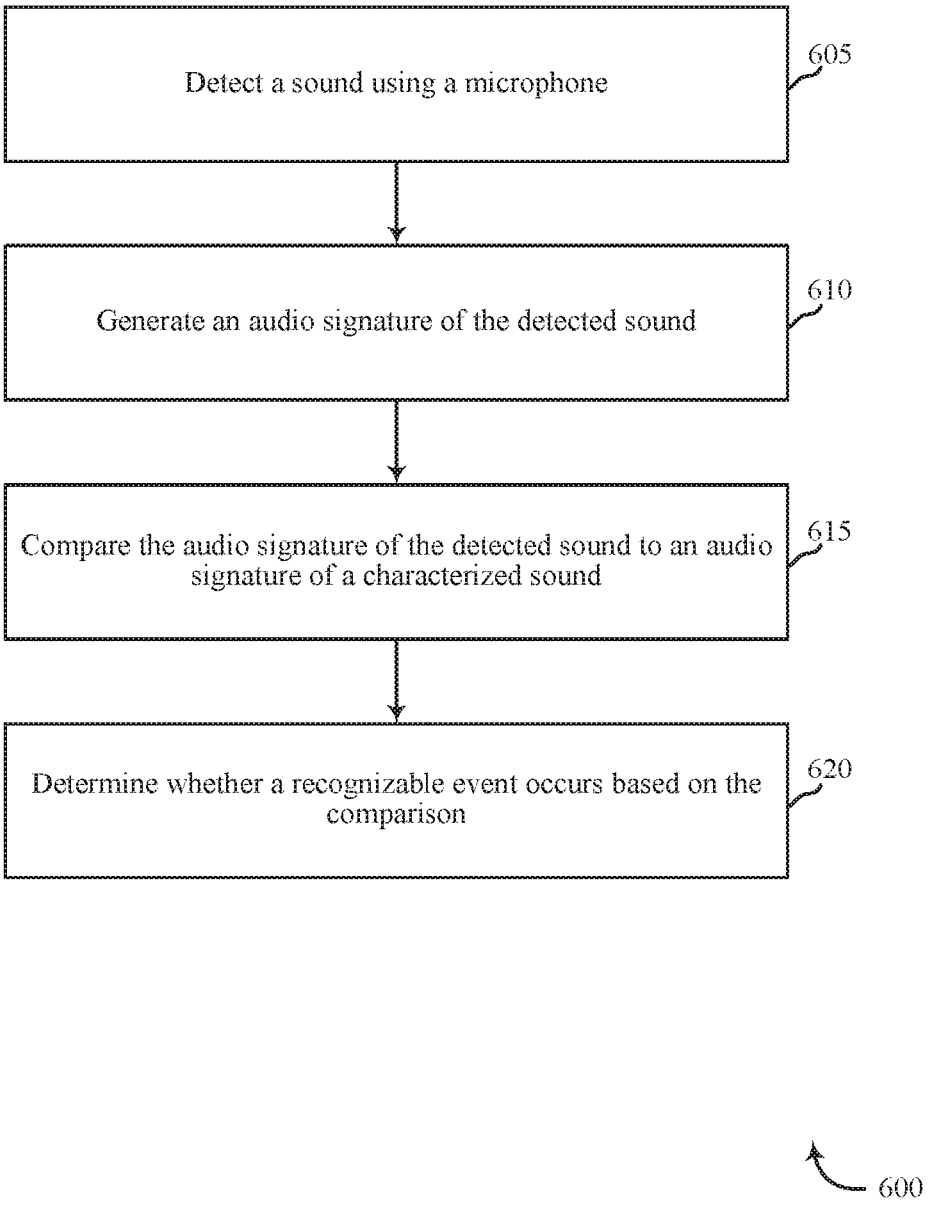
FIG. 6 is a flow chart illustrating an example of a method relating to a security and/or an automation system, in accordance with various aspects of this disclosure.

FIG. 6 is a flow chart illustrating an example of a method 600 for home automation, in accordance with various aspects of the present disclosure. For clarity, the method 600 is described below with reference to aspects of one or more of the sensor units 110 described with reference to FIGS. 1, 4, and/or 5. In some examples, a control panel, backend server, mobile computing device, and/or sensor may execute one or more sets of codes to control the functional elements of the control panel, backend server, mobile computing device, and/or sensor to perform one or more of the functions described below. Additionally or alternatively, the control panel, backend server, mobile computing device, and/or sensor may perform one or more of the functions described below using special-purpose hardware.

At block 605, method 600 may include detecting a sound using a microphone. At block 610, method 600 may include generating an audio signature of the detected sound. At block 615, method 600 may include comparing the audio signature of the detected sound to an audio signature of a characterized sound. At block 620, method 600 may include determining whether a recognizable event occurs based on the comparison. The operation(s) at block 605-620 may be performed using the event detection module 215 described with reference to FIGS. 2-5 and/or another module.

Thus, the method 600 may provide for detecting events relating to automation/security systems. It should be noted that the method 600 is just one implementation and that the operations of the method 600 may be rearranged, omitted, and/or otherwise modified such that other implementations are possible and contemplated.

Figure 7:
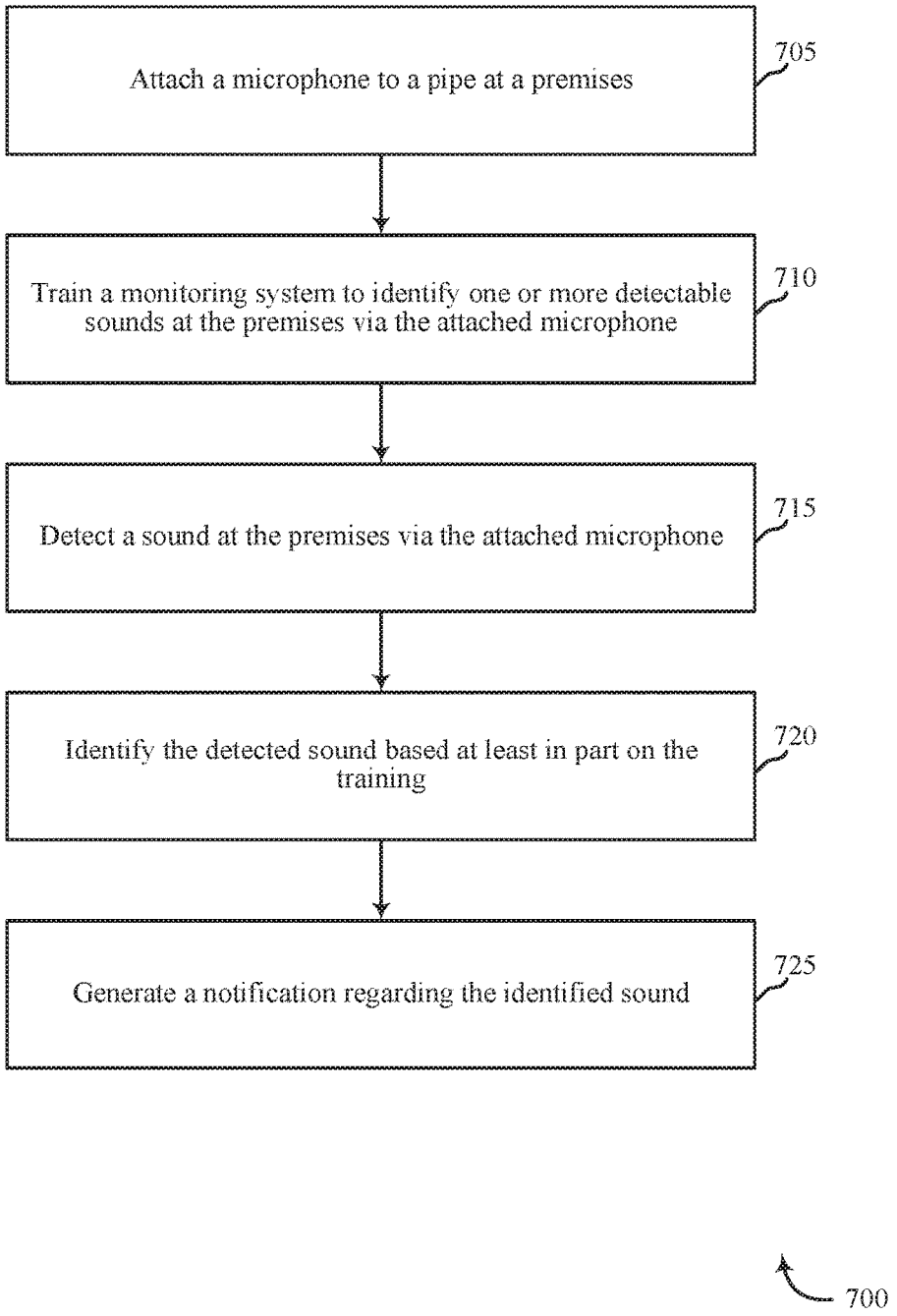
FIG. 7 is a flow chart illustrating an example of a method relating to a security and/or an automation system, in accordance with various aspects of this disclosure.

FIG. 7 is a flow chart illustrating an example of a method 700 for home automation, in accordance with various aspects of the present disclosure. For clarity, the method 700 is described below with reference to aspects of one or more of the sensor units 110 described with reference to FIGS. 1, 4, and/or 5. In some examples, a control panel, backend server, mobile computing device, and/or sensor may execute one or more sets of codes to control the functional elements of the control panel, backend server, mobile computing device, and/or sensor to perform one or more of the functions described below. Additionally or alternatively, the control panel, backend server, mobile computing device, and/or sensor may perform one or more of the functions described below using special-purpose hardware.

At block 705, method 700 may include attaching a microphone to a pipe at a premises. At block 710, method 700 may include training a monitoring system to identify one or more detectable sounds at the premises via the microphone attached to the pipe. Examples of the monitoring system include the communications system 100 of FIG. 1, the apparatus 205 of FIG. 2, apparatus 205-*a* of FIG. 3, system 400 of FIG. 4, event detection module 215 of FIGS. 2, 3, 4, and/or 5, or any combination thereof.

At block 715, method 700 may include detecting a sound at the premises via the microphone. At block 720, method 700 may include identifying the detected sound based at least in part on the training. For example, method 700 may identify the detected sound based on analysis that is performed based on at least a portion of the training. At block 725, method 700 may include generating a notification regarding the identified sound. The operations at blocks 705-725 may be performed using the event detection module 215 described with reference to FIGS. 2-5 and/or another module.

Thus, the method 700 may provide for detecting events relating to automation/security systems. It should be noted that the method 700 is just one implementation and that the operations of the method 700 may be rearranged, omitted, and/or otherwise modified such that other implementations are possible and contemplated.

In some examples, aspects from two or more of the methods 600 and 700 may be combined and/or separated. It should be noted that the methods 600 and 700 are just example implementations, and that the operations of the methods 600 and 700 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one" of or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, comprising:

detecting a sound using a microphone;

generating an audio signature of the detected sound;

comparing the audio signature of the detected sound to an audio signature of a characterized sound;

when the audio signature of the detected sound matches the audio signature of the characterized sound, logging information related to the detected sound to a database where the audio signature of the characterized sound is stored and performing an automation task, the automation task comprising at least one of adjustment of a light setting in the premises, adjustment of a thermostat setting of the premises, adjustment of an appliance setting in the premises, adjustment of a machine in the premises, adjustment of a machine setting in the premises, adjustment of an automated locking mechanism, adjustment of a setting of the automation system, or any combination thereof; and when the audio signature of the detected sound does not match the audio signature of the characterized sound, characterizing the non-matching detected sound.

2. The method of claim 1, wherein the microphone is attached to a pipe at the premises.

3. The method of claim 1, comprising:

monitoring for recurrences of the characterized sound to identify typical times when the characterized sound occurs, typical rate of occurrence for the characterized sound, typical time span associated with the characterized sound, or any combination thereof.

4. The method of claim 1, comprising:

when the audio signature of the detected sound does not match the audio signature of the characterized sound:

generating a notification regarding the non-matching detected sound, the notification including at least a request for information regarding the non-matching detected sound.

5. The method of claim 4, wherein the notification includes a prompt of whether to monitor for subsequent incidents of the non-matching detected sound.

6. The method of claim 5, comprising:

when a response to the prompt indicates to monitor for subsequent incidents of the non-matching detected sound:

adding an audio signature of the non-matching detected sound to a database; and logging information related to the non-matching detected sound to the database upon detecting a subsequent incident of the non-matching detected sound.

7. The method of claim 5, comprising:

when a response to the prompt indicates not to monitor for subsequent incidents of the non-matching detected sound, discarding an audio signature of the non-matching detected sound.

8. The method of claim 1, wherein the one or more attributes of the characterized sound includes at least one of pitch, frequency, wavelength, timbre, tone, and amplitude, or any combination thereof.

9. The method of claim 1, wherein the characterized sound includes a first occupant exiting a first door, a second occupant exiting the first door, the first or second occupant exiting a second door, a garage door opening or closing, a first car starting, a second car starting, the first car leaving the premises, the second car leaving the premises, the first car arriving at the premises, the second car arriving at the premises, voice of the first occupant, voice of the second occupant, the first occupant getting into or out of a first bed, the second occupant getting into or out of a second bed, the first or second occupant walking from a first room to a second room, a furnace operating, an air conditioner operating, a swamp cooler operating, a television operating, a clothes washer operating, a clothes dryer operating, a dishwasher operating, a refrigerator operating, confirming an occurrence of an expected event within a certain time period, or any combination thereof.

10. An apparatus for an automation system, comprising:

a processor;

memory in electronic communication with the processor; and instructions stored in the memory, the instructions being executable by the processor to:

detect a sound using a microphone;

generate an audio signature of the detected sound;

compare the audio signature of the detected sound to an audio signature of a characterized sound;

when the audio signature of the detected sound matches the audio signature of the characterized sound, log information related to the detected sound to a database where the audio signature of the characterized sound is stored and perform an automation task, the automation task comprising at least one of adjustment of a light setting in the premises, adjustment of a thermostat setting of the premises, adjustment of an appliance setting in the premises, adjustment of a machine in the premises, adjustment of a machine setting in the premises, adjustment of an automated locking mechanism, adjustment of a setting of the automation system, or any combination thereof; and when the audio signature of the detected sound does not match the audio signature of the characterized sound, characterize the non-matching detected sound.

11. The apparatus of claim 10, wherein the microphone is attached to a pipe at the premises.

12. The apparatus of claim 10, the instructions being executable by the processor to:

monitor for recurrences of the characterized sound to identify typical times when the characterized sound occurs, typical rate of occurrence for the characterized sound, typical time span associated with the characterized sound, or any combination thereof.

13. The apparatus of claim 10, the instructions being executable by the processor to:

when the audio signature of the detected sound does not match the audio signature of the characterized sound:

generate a notification regarding the non-matching detected sound, the notification including at least a request for information regarding the non-matching detected sound.

14. The apparatus of claim 10, wherein, the one or more attributes of the characterized sound including at least one of pitch, frequency, wavelength, timbre, tone, and amplitude, or any combination thereof.

15. A non-transitory computer-readable medium storing computer-executable code for an automation system, the code executable by a processor to perform the steps of:

detecting a sound using a microphone;

generating an audio signature of the detected sound;

comparing the audio signature of the detected sound to an audio signature of a characterized sound;

when the audio signature of the detected sound matches the audio signature of the characterized sound, logging information related to the detected sound to a database where the audio signature of the characterized sound is stored and performing an automation task, the automation task comprising at least one of adjustment of a light setting in the premises, adjustment of a thermostat setting of the premises, adjustment of an appliance setting in the premises, adjustment of a machine in the premises, adjustment of a machine setting in the premises, adjustment of an automated locking mechanism, adjustment of a setting of the automation system, or any combination thereof; and when the audio signature of the detected sound does not match the audio signature of the characterized sound, characterizing the non-matching detected sound.

16. The non-transitory computer-readable medium of claim 15, wherein the microphone is attached to a pipe at the premises.

* * * * *